US006572082B1

(12) United States Patent
Dixon et al.

(10) Patent No.: US 6,572,082 B1
(45) Date of Patent: Jun. 3, 2003

(54) RAILWAY BOXCAR DOOR OPERATING UNIT

(75) Inventors: Thomas E. Dixon, Vancouver, WA (US); James E. Brosh, Beaverton, OR (US); Brian D. Campbell, Vancouver, WA (US); Richard R. Estep, Vancouver, WA (US); Larry D. Marshal, Estacada, OR (US)

(73) Assignee: Cascade Corporation, Fairview, OR (US)

( * ) Notice: Subject to any disclaimer, the term of this patent is extended or adjusted under 35 U.S.C. 154(b) by 0 days.

(21) Appl. No.: 09/995,329

(22) Filed: Nov. 27, 2001

(51) Int. Cl.[7] ..... B66D 1/00; B66D 1/36
(52) U.S. Cl. ..... 254/323; 254/326
(58) Field of Search ..... 254/323, 325, 254/326, 327

(56) References Cited

U.S. PATENT DOCUMENTS

| | | | | |
|---|---|---|---|---|
| 1,690,262 A | | 11/1928 | Westling | |
| 2,490,772 A | | 12/1949 | Benner | |
| 2,809,759 A | | 10/1957 | Manker | |
| 3,007,592 A | | 11/1961 | Adams | |
| 3,797,672 A | * | 3/1974 | Vermette | 52/116 |
| 4,127,295 A | * | 11/1978 | Robinson | 293/117 |
| 4,149,644 A | | 4/1979 | Fuller | |
| 4,160,509 A | | 7/1979 | Switzer | |
| 4,290,368 A | | 9/1981 | Mazzini | |
| 4,290,730 A | | 9/1981 | Weaver | |
| 4,726,566 A | * | 2/1988 | Boland et al. | 254/325 |
| 5,302,072 A | | 4/1994 | Stauffer et al. | |
| 5,522,582 A | * | 6/1996 | Dilks | 254/323 |
| 5,593,139 A | * | 1/1997 | Julian | 36/18 |
| 5,632,470 A | * | 5/1997 | Leland | 254/385 |
| 5,794,920 A | * | 8/1998 | Kronberger | 254/361 |
| 5,842,684 A | * | 12/1998 | Aho | 254/344 |
| 5,909,870 A | * | 6/1999 | Funk | 254/325 |

FOREIGN PATENT DOCUMENTS

GB 2 154 194 9/1985

* cited by examiner

*Primary Examiner*—Kathy Matecki
*Assistant Examiner*—Evan Langdon
(74) *Attorney, Agent, or Firm*—Chernoff, Vilhauer, McClung & Stenzel, LLP

(57) ABSTRACT

A door operating apparatus is provided for safely and efficiently opening and/or closing a side door of a railway boxcar by moving a door engagement member laterally.

28 Claims, 4 Drawing Sheets

RAILWAY BOXCAR DOOR OPERATING UNIT

BACKGROUND OF THE INVENTION

The present invention relates to an assembly for selectively opening and/or closing a side door of a railway boxcar.

Railway boxcars commonly have a side door so that the boxcar may be opened and closed for loading and unloading. A side door is typically mounted on a track so that the side door may slide laterally between an open position and a closed position along the side of the boxcar.

However, problems are frequently encountered when manually operating a side door of a boxcar, especially when the boxcar is loaded or has a damaged side door. Cargo has a tendency to shift during transport so that the weight of the cargo bears on the door as it is opened, making it much more difficult to slide the side door manually along the track and causing injuries from strains or falls to persons attempting to do so. Comparable resistance to sliding occurs even in the case of an unloaded boxcar if the side door is damaged, causing similar injuries. Also, the cargo may potentially fall upon a person operating the side door as it is opened. Worse still, the weight of the cargo upon the side door will sometimes cause the side door to jump the track and fall as it is being opened, further endangering the person opening the door. Moreover, with a newly loaded boxcar the bulk of the cargo may protrude into the doorway opening, making it difficult or impossible to slide the side door into a closed position manually.

Because of the foregoing difficulties in opening and closing a side door of a boxcar, it has been common to use mechanized equipment, such as a lift truck, to provide the needed force to overcome resistance to sliding of the door. For example, by engaging the forks of the lift truck with a handle on the side door, the side door can be opened by driving the lift truck forward along the length of the boxcar. Unfortunately, use of this method still exposes the lift truck operator to the risk of falling cargo as the side door is opened. Also, because of the transverse forces caused by the lift truck on the side door, using a lift truck in this fashion makes it potentially more likely that the side door will jump the tracks, causing personal injury or property damage.

Switzer, U.S. Pat. No. 4,160,509, discloses a lift truck attachment having dual sleeves that fit over the forks of a lift truck. A rigid beam is mounted transversely over the sleeves and terminates at a point broadside of the lift truck. At the broadside end of the rigid beam is a hook and chain assembly that connects to the side door. The lift truck can thus be used to pull the door open as it drives backwards and to push the door shut as it drives forward, so that the lift truck operator is largely free of the path of any cargo that might fall. Similarly, Weaver, U.S. Pat. No. 4,290,730 and Fuller, U.S. Pat. No 4,149,644 both disclose lift truck attachments that provide for rigid, lateral connection to a side door of a boxcar at a point broadside of the lift truck.

The existing assemblies just described also have disadvantages, however. Principally, there is often insufficient space alongside the length of the boxcar to drive a lift truck a sufficient distance to open or close the side door. Also, depending on the weight of the side door relative to the lift truck, if the side door jumps its track the connection to the lift truck may lead the lift truck to tip over, injuring the operator.

What is desired, therefore, is a railway boxcar door operating assembly that operates side doors of boxcars easily whether the boxcar is loaded or empty, that protects the operator from injury as the side door is opened, and that is operable in close quarters.

BRIEF SUMMARY OF THE INVENTION

The present invention addresses the foregoing concerns by providing a rail car side door operating apparatus having a mobile frame or vehicle, an engagement member attachable to the side door, and a power actuator assembly that forces lateral movement of the engagement member relative to the frame or vehicle to operate the door.

The foregoing and other objectives, features, and advantages of the invention will be more readily understood upon consideration of the following detailed description of the preferred embodiment of the invention, taken in conjunction with the accompanying drawings.

DETAILED DESCRIPTION OF A PREFERRED EMBODIMENT

Figure 1:
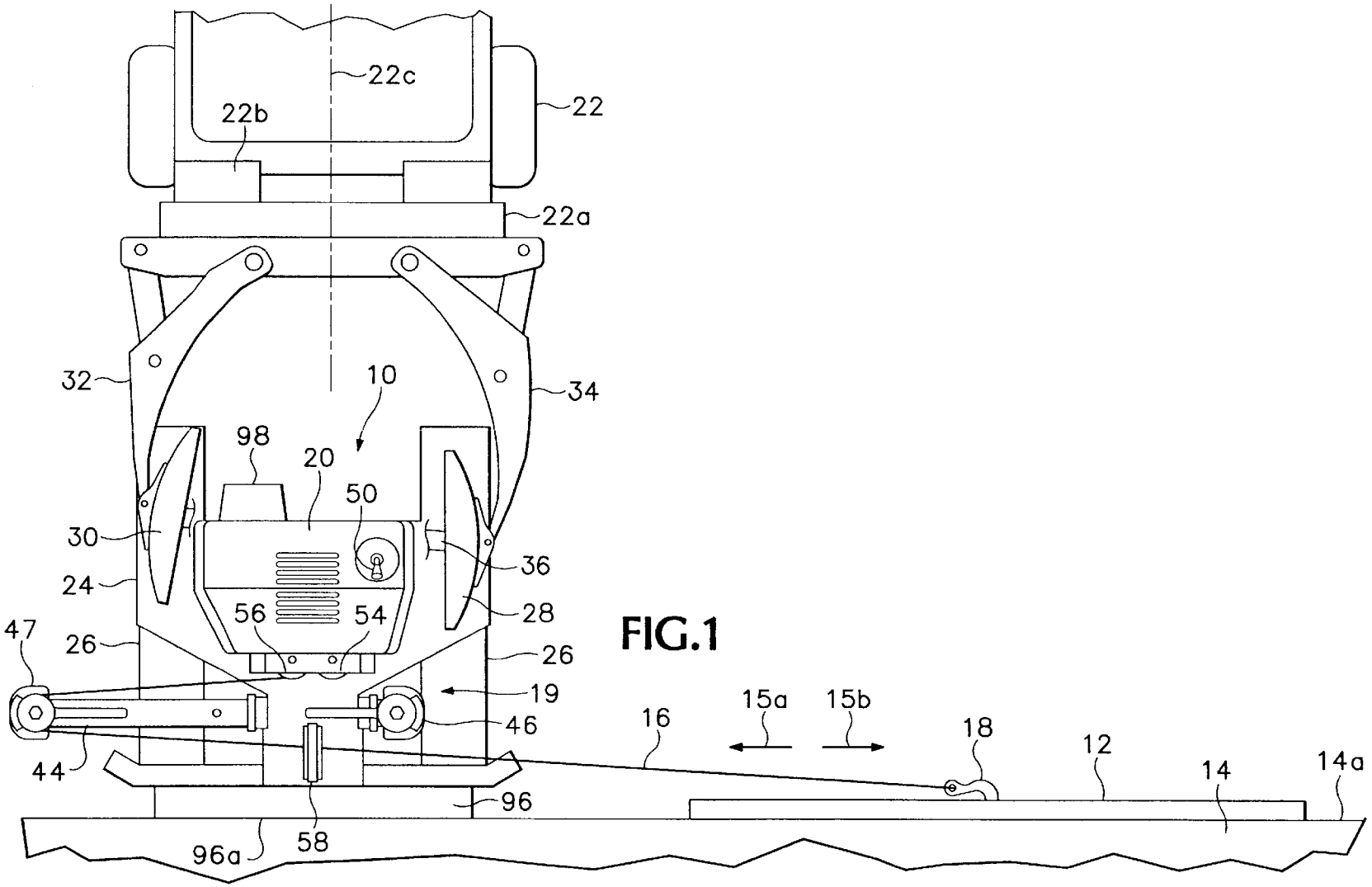
FIG. 1 is a top view of an exemplary railway boxcar door operating unit shown attached to a lift truck and operating a side door of a railway boxcar.

Referring to the drawings which form a part of the disclosure herein, and wherein like numerals refer to like elements, FIG. 1 shows a door operating assembly 10 connected to a side door 12 of a rail car 14. The side door 12 is mounted on tracks (not shown) so that the side door 12 may slide from the closed position depicted in FIG. 1 to an open position and back again in respective opposite, generally lateral directions 15*a* and 15*b* along the side 14*a* of the rail car 14. The door operating assembly 10 is carried portably by a vehicle, such as an automotive lift truck 22 having a load-lifting apparatus which includes a carriage 22*a* on a mast 22*b* shown in partial view in FIG. 1. The lift truck 22 has a direction of travel coincident with its centerline 22*c*, extending perpendicular to the axis of rotation of its wheels. Such vehicle could also be some other type of mobile vehicle, such as an automotive hauling truck, a hand truck, a cart, etc.

The door operating assembly 10 includes an engagement member 16 attachable to the side door 12. In the preferred embodiment shown in FIG. 1, the engagement member 16 is a flexible tension member such as a cable that is attached to the side door 12 with a hook 18 sized to engage a handle (not shown) on the side door 12. The door operating assembly 10 also includes a power actuator assembly 19, which in the preferred embodiment includes a winch 20. The cable 16 is engaged with the power actuator assembly 19 so that, when activated, the assembly 19 can force movement of the cable 16 relative to the lift truck in a substantially lateral, transverse direction traversing the centerline 22*c* of the lift truck. In this fashion, the side door 12 may selectively be pulled open or shut depending on which side of the side door 12 the door operating assembly 10 is located.

The assembly 10 permits operation of the side door 12 while the lift truck 22 remains stationary and to one side of the rail car door opening. Both the lift truck 22 and its operator may therefore remain at all times during operation of the side door 12 away from the area where any objects might fall from the rail car 14. Further, because the lift truck 22 need not move alongside the rail car 14 in order for operation of the side door 12, operation of the side door 12 does not require that there be much space available alongside the length of the rail car 14.

Figure 2:
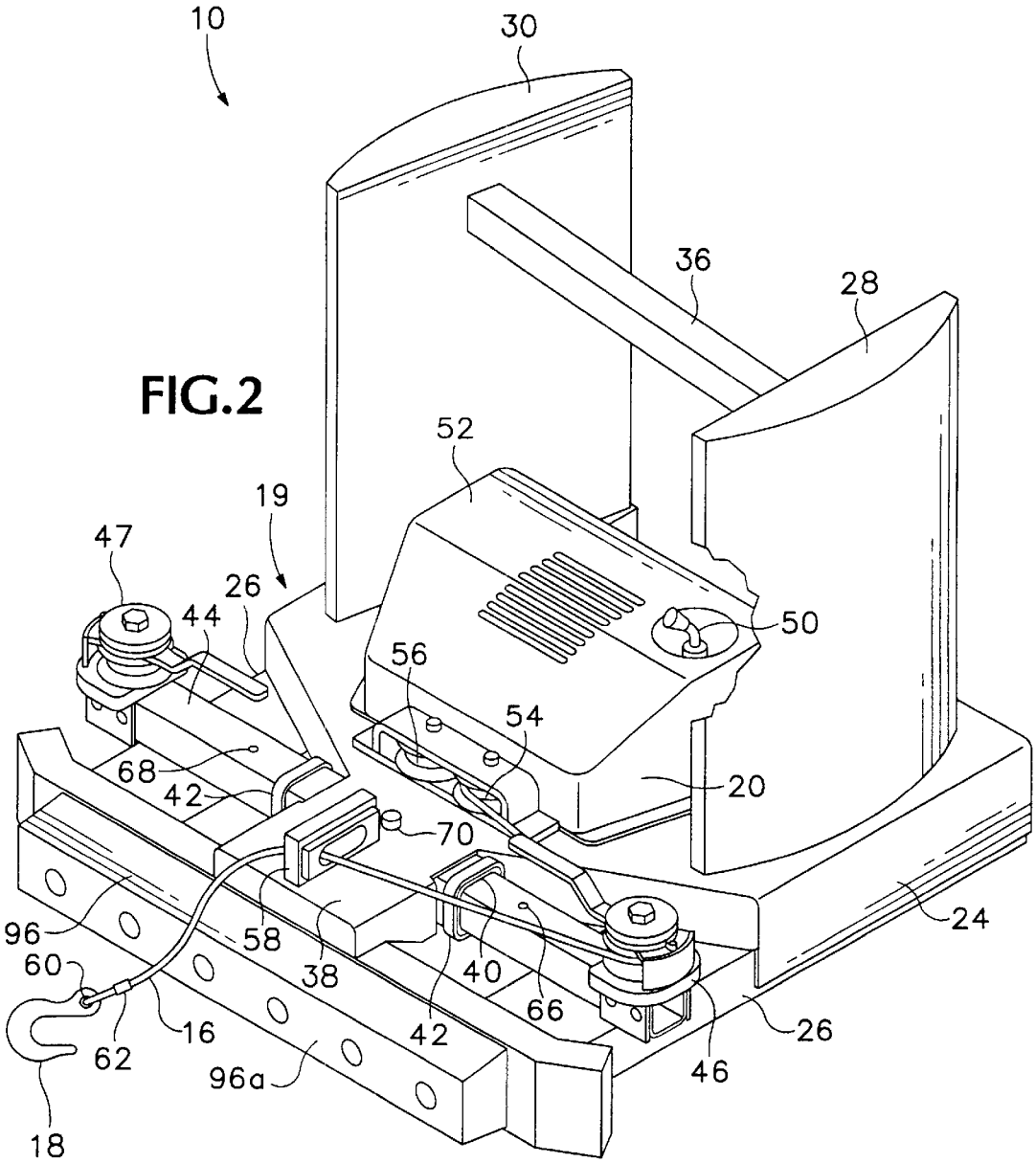
FIG. 2 is a perspective view of the railway boxcar door operating unit shown in FIG. 1.
Figure 3:
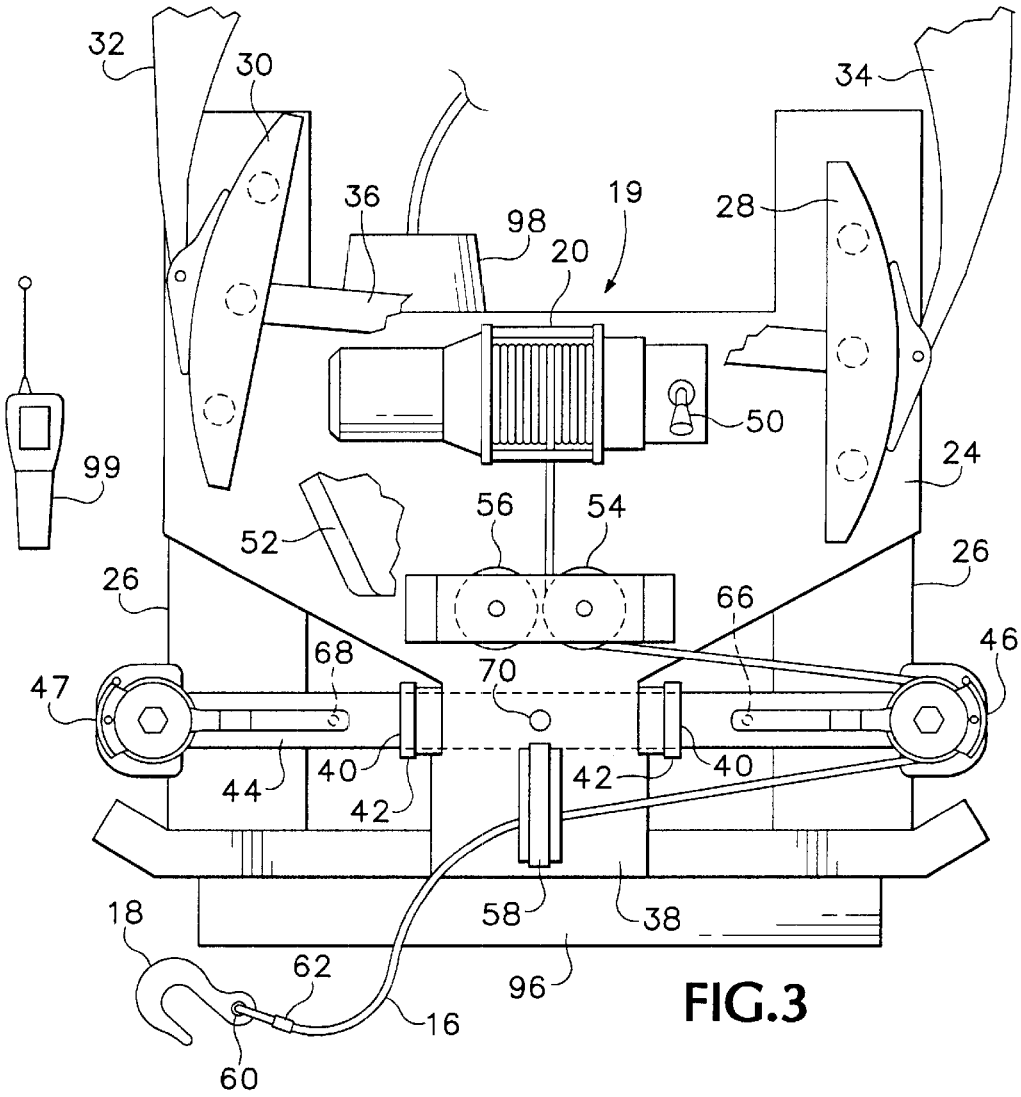
FIG. 3 is a partial top view, at an enlarged scale, of the railway boxcar door operating unit shown in FIG. 1.

Referring to FIGS. 2 and 3, the door operating assembly 10 comprises a frame 24 having two hollow rigid sleeve members 26 spaced apart from one another an appropriate distance so that load-lifting forks (not shown) of the lift truck 22 may be matingly inserted into the sleeves 26, facilitating quick and easy attachment or detachment of the door operating assembly 10 with respect to the lift truck 22.

As an alternative to forks, many lift trucks are equipped with two opposed clamp arms that can firmly grasp paper rolls or other cylindrical objects. Such objects frequently need to be grasped from a horizontal position where it is difficult to position a clamp arm underneath the object to provide support while lifting. To compensate, the cylindrical-object clamp arms of a typical lift truck include a short clamp arm 32 and a long clamp arm 34, as shown in FIG. 3. This allows horizontal cylindrical objects to be grasped along a diametrical line that slants upward and away from the. lift truck, rather than a vertical diametrical line which would require positioning a clamp arm underneath the object before lifting.

To facilitate an alternate means of mating attachment of the door operating assembly 10 detachably to the lift truck 22, aside from the sleeves 26 described earlier, the frame 24 also preferably includes a left arcuate member 28 and a right arcuate member 30 that together emulate a partial perimeter of a cylinder that may then be grasped by the short clamp arm 32 and the long clamp arm 34. A compression member 36 is positioned between the left arcuate member 28 and the right arcuate member 30 for support while the door opening assembly 10 is being grasped by the clamp arms 32 and 34, respectively, of the lift truck 22. As can be seen in FIG. 3, the right clamp member 30 is preferably diametrically offset from the left clamp member 28 at an angle of approximately 30° to enable lift trucks having clamp arms 32 and 34 of differing lengths to more effectively grasp the assembly 10.

The winch 20 rests on top of the frame 24 and comprises a conventional automotive winch with a release lever 50, and a protective housing 52. The release lever 50 selectively engages and disengages the spool of the winch 20 with respect to its electric motor powered by the lift truck's battery (not shown), so that the cable 16 can be unwound from the winch by pulling the cable manually. The cable is then attached to the side door 12 and pulled in mechanically by the winch.

The frame 24 of the door operating assembly 10 tapers to a forward portion 38, which supports a guide component of the power actuator assembly 19. The guide component comprises a lateral tube portion 40 with a collar 42 at either end, slidably supporting an arm 44 having a left guide pulley assembly 46 and a right guide pulley assembly 47. These guide pulley assemblies receive the cable 16 from the winch via respective pulleys 54 and 56, and guide the cable along a path which laterally traverses the centerline 22*c* of the lift truck.

The door operating assembly 10 is capable of operating side door 12 from either side to open or close it. The cable 16 is wound around the winch 20 and extends outward between the pulleys 54, 56. If the side door 12 is being operated from the right (as viewed from the lift truck 22) as depicted in FIG. 1, the cable 18 loops around the right guide pulley assembly 47 and preferably through a cable retainer 58 to terminate at a hook 18. The hook 18 may define an eye hole 60 through which the cable 16 may pass and be fastened by a fastener 62. The release lever 50 may be switched to the disengaged position so the cable 16 can be taken out manually to be fastened to the side door 12 of the rail car 14 with the hook 18. Then the release lever may be switched to the engaged position so that the winch 20 may reel in the cable 16 and thus operate the side door 12. Alternatively, if the side door is to be operated from the left (again from the perspective of the lift truck 22) as depicted in FIG. 3, the cable 16 may simply be looped around the left guide pulley assembly 46 and through the retainer 58. The retainer 58 assures that the cable 16 is reeled in or out at a gentle angle with respect to the guide pulley assembly 46 or 47 to prevent the cable 16 from binding or chafing within the guide pulley assembly.

Figure 4:
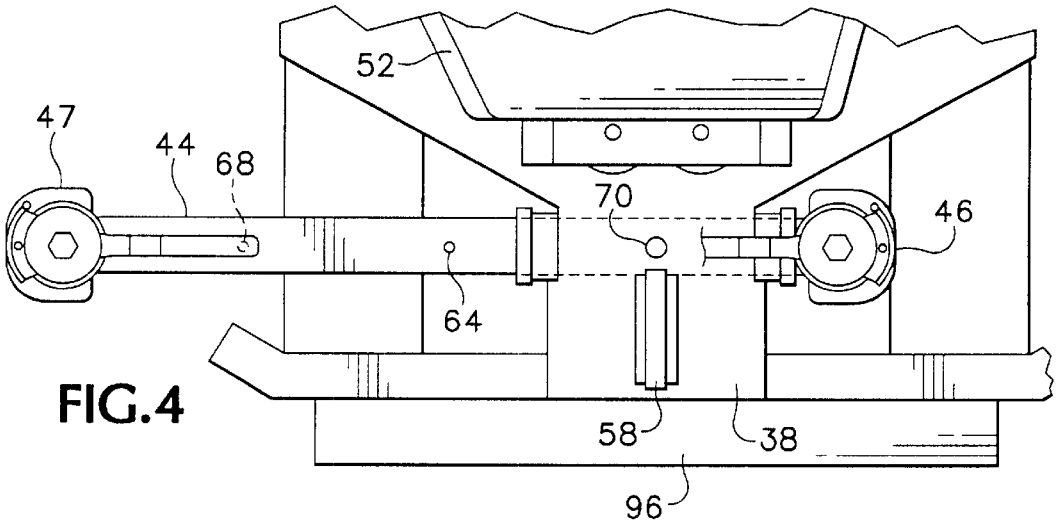
FIG. 4 is a partial top view of the forward portion of the railway boxcar door operating unit shown in FIG. 3.

Sometimes space limitations necessitate that the lift truck 22, and hence the door operating assembly 10, be positioned in close lateral proximity to the side door 12. In that instance, there is only limited pull distance available for operating the side door 12. To compensate, the preferred embodiment includes adjustability of the arm 44 so that it may slide laterally to either the left or the right of the door operating assembly 10 to create more pull distance. When more pull distance is needed, the operator does not pass the cable through the retainer 58. Referring to FIGS. 2 and 4, the adjustable arm 44 is slidably engaged with the forward portion 38 of the frame 24 through the lateral tube portion 40 and slide collars 42. A pin 70 is fitted through the forward portion 38 of the frame 24. The adjustable arm 44 includes a center socket 64, a left socket 66, and a right socket 68 that are each sized to accommodate the pin 70. Once the appropriate socket is aligned with the pin 70 by sliding the adjustable arm 44 to the appropriate position, the pin 70 may be engaged within the socket to hold the adjustable arm 44 in place.

Figure 5:
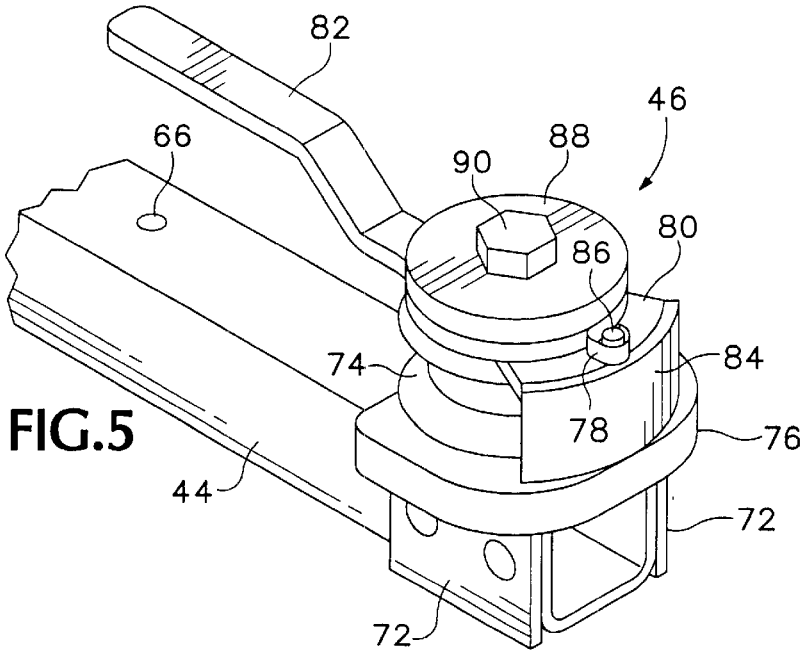
FIG. 5 is a perspective view of a pulley assembly used in the railway boxcar door operating unit of FIG. 1.

FIG. 5 shows guide pulley assembly 46, which is similar to pulley assembly 47. Each guide pulley assembly includes a sheave base member 76, a guide pulley 74, a guard member 80, a torsion spring 78, a cap 88 and a bolt 90. In the guide pulley assembly depicted, the guide pulley 74 is supported by the sheave base member 76 and is designed to facilitate smooth passage of the cable 16 as it is being taken out by the operator or pulled in by the winch 20. The sheave base member 76 rests on the adjustable arm 44 and has two opposed legs 72 that extend downward to either side of the adjustable arm 44. The legs 72 of the sheave base member 76 may be secured to the adjustable arm 44 with one or more bolts, rivets, or any other conventional method.

Figure 7:
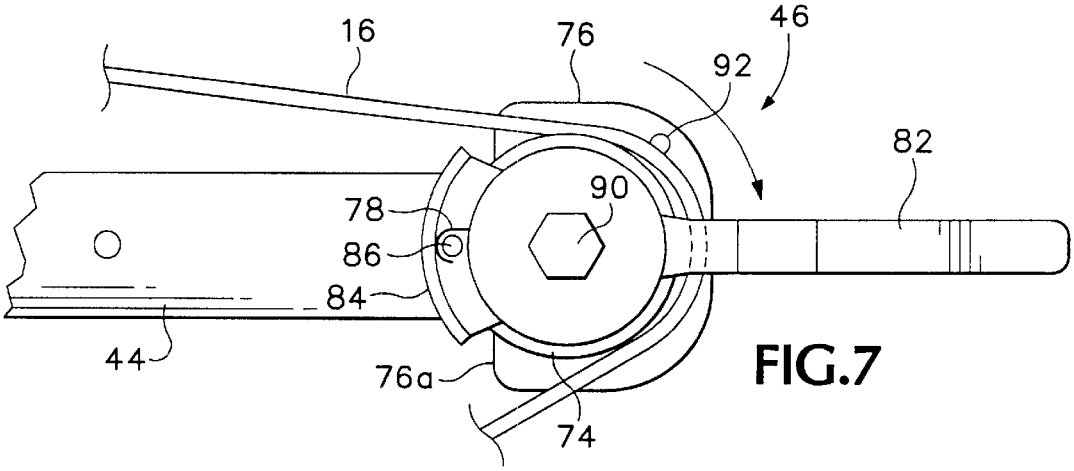
FIG. 7 is a top view of the pulley assembly of FIG. 5, shown in an open position.

The guard member 80 rests on the pulley 74 and has a vertical retaining shield 84 at one end and a handle 82 at the other. The retaining shield 84 is designed to cover a portion of the groove in the pulley 74, and the handle 82 permits an operator to rotate the shield 84 around the pulley 74. A peg 86 protrudes upwardly from the guard member 80 to engage with the torsion spring 78 that rests on top of the guard member. The torsion spring 78 is relatively relaxed when the handle 82 of the guard member 80 is aligned toward the adjustable arm 44, and provides an increased resisting force when the handle 82 is rotated away from the arm 44 as shown in FIG. 7. The cap 88 rests on top of the torsion spring 78 and, together with the bolt 90, holds the guide pulley assembly 46 together while anchoring the torsion spring and permitting rotation of the guard member 80 and the guide pulley 74.

Figure 6:
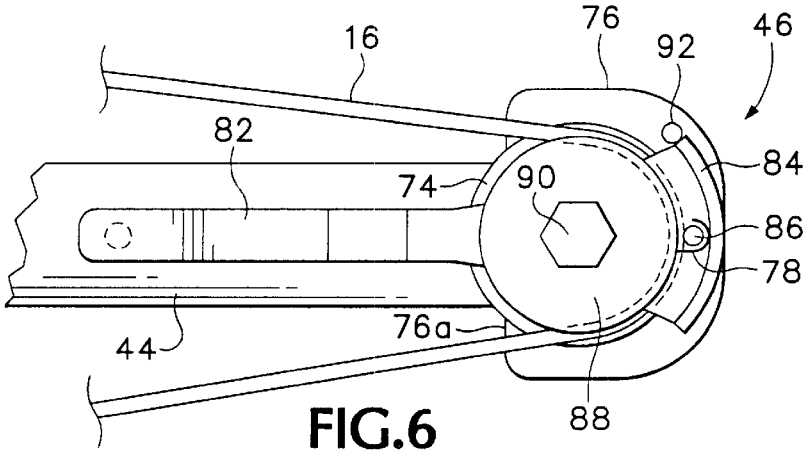
FIG. 6 is a top view of the pulley assembly of FIG. 5, shown in a closed position.

Referring to FIGS. 5 and 6, the guide pulley assembly 46 described above allows for easy engagement and disengagement of the cable 16 when it is necessary to reposition the cable 16 to pass through the opposite guide pulley assembly to reverse the lateral direction of pull. FIG. 6 shows the cable 16 passing through the guide pulley assembly 46 which in this figure is in its closed position. The retaining shield 84 is outside the perimeter of the cable 16 that is looped around the guide pulley 74 so that any slack existing in the cable 16 will not cause the cable 16 to slip from the guide pulley 74.

FIG. 7 shows the cable 16 passing through the guide pulley assembly 46 in its open position, achieved by manually rotating the handle 82 in a clockwise direction against the resisting force of the torsion spring 78 until the retaining shield 84 frees the cable 16 by rotating into the region inwardly of the inside edge 76*a* of the base member 76 as shown in FIG. 7. Slack in the cable 16 then allows the cable to be easily pulled up over the handle 82 and free of the guide pulley assembly 46 for transfer to the opposite guide pulley assembly 47. Conversely, the cable 16 may be easily re-engaged with the guide pulley 74 in this position of the handle 82 by looping the cable 66 under the handle 82 and into the groove of the guide pulley 74, then releasing the handle 82. The torsion spring 78 will then cause the retaining shield 84 to rotate to the closed position, capturing the cable 16 as shown in FIG. 6. A peg 92 prevents the retaining shield 84 from being rotated beyond the closed position by the torsion spring 78.

Referring again to FIGS. 1 and 2, the door operating assembly 10 is also equipped with a bumper 96 that contacts the side of the rail car to properly align the assembly 10 by means of an engagement surface 96*a* extending transverse to the direction of travel of the lift truck. Also, the bumper may be used to adjust or compress cargo within the rail car 14 to ensure a clear path when closing the side door 12.

The door operating assembly 10 is also equipped with a winch controller unit 98 (FIG. 3) that permits operation of the door operating assembly, either from the lift truck 22 or from a remote location when the operator is attaching the cable to the door, by means of a portable hand-held switch 99 communicating preferably by wireless transmission with the controller unit 98.

Equivalents of the structures utilized in the foregoing preferred embodiment could alternatively be used to satisfy the objectives of the invention. For example, the lift truck 22 could also be some other type of vehicle, such as an automotive hauling truck, a hand truck, a cart, etc. If such a vehicle is not by itself massive enough to resist the force which must be exerted on the engagement member 16, such vehicle or the assembly 10 can be anchored to the rail car 14. Although movement of the flexible tension member transverse to the direction of travel of the vehicle is preferred, lateral movement in other directions, such as parallel to the direction of travel, could be utilized.

The means of attachment of the assembly 10 is also variable. For example, if the vehicle is a lift truck, the assembly 10 could be attachable to the load-lifting carriage 22*a* rather than to a load-engaging implement such as forks or a clamp, although the preferred embodiment has the advantage of not requiring removal of the load-engaging implement in order to mount the assembly 10 on the lift truck. Also, the assembly 10 might be mountable matingly on only one type of load-handling implement, such as forks, rather than alternatively on multiple types as shown. The winch 20 could be hydraulically or mechanically driven by an engine, rather than electrically driven, or could utilize a flexible tension member other than a cable, such as a chain. The guide component with its pulley assemblies 46 and 47 may or may not be required, depending upon the application.

The terms and expressions employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. Door operating apparatus for moving a side door of a rail car relative to said rail car, said operating apparatus comprising:

(a) a vehicle which is selectively movable relative to said rail car;

(b) an engagement member attached to said side door; and (c) a power actuator assembly supported by said vehicle and capable of forcing movement of said engagement member relative to said vehicle in a substantially lateral direction to move said side door.

2. The apparatus of claim 1 wherein said vehicle is automotive.

3. The apparatus of claim 1 wherein said power actuator assembly is capable of forcing said movement of said engagement member while said vehicle remains stationary.

4. The apparatus of claim 1 wherein said power actuator assembly is capable of forcing said movement of said engagement member in a direction substantially transverse to a direction of travel of said vehicle.

5. The apparatus of claim 1 wherein said power actuator assembly is capable of forcing said movement of said engagement member so as to traverse a centerline of said vehicle which extends along a direction of travel thereof.

6. The apparatus of claim 1 wherein said engagement member is a flexible tension member and said power actuator assembly includes a winch from which said tension member extends.

7. The apparatus of claim 6 wherein said tension member engages at least one pulley having a rotational axis whose position is adjustable relative to said frame in a direction substantially transverse to a direction of travel of said vehicle.

8. The apparatus of claim 1 wherein said power actuator assembly is capable of forcing movement of said engagement member selectively in either of two opposite substantially lateral directions.

9. The apparatus of claim 1, including a bumper having an engagement surface extending substantially transverse to a direction of travel of said vehicle.

10. The apparatus of claim 1, including a controller enabling selective operation of said power actuator assembly from a location remote from said vehicle.

11. Door operating apparatus for moving a side door of a rail car relative to said rail car, said operating apparatus comprising:

(a) a frame attachable to a vehicle;

(b) an engagement member attachable to said side door;

(c) a power actuator assembly supported by said frame and capable, when said frame is attached to said vehicle, of forcibly moving said engagement member so as to traverse a centerline of said vehicle which extends along a direction of travel thereof; and (d) first and second rotatable members, each supported by said frame and capable of engaging said engagement member, one of said first and second rotatable members being transversely spaced further apart from said centerline, and spaced further apart from said power actuator assembly along said direction of travel, than said other of said rotatable members.

12. The apparatus of claim 11 wherein said vehicle is automotive.

13. The apparatus of claim 11 wherein said engagement member is a flexible tension member and said power actuator assembly includes a winch from which said tension member extends.

14. The apparatus of claim 13 wherein said power actuator assembly includes at least one pulley engageable by said tension member and having a rotational axis whose position is adjustable relative to said frame in a direction substantially transverse to said direction of travel when said frame is attached to said vehicle.

15. The apparatus of claim 11, including a bumper having an engagement surface extending substantially transverse to said direction of travel when said frame is attached to said vehicle.

16. The apparatus of claim 11, including a controller enabling selective operation of said power actuator assembly from a location remote from said vehicle when said frame is attached to said vehicle.

17. The apparatus of claim 11, further including at least a third rotatable member supported by said frame and capable of engaging said engagement member, at least two of said first, second, and third rotatable members being transversely spaced apart from said center line on opposite sides thereof.

18. Door operating apparatus for moving a side door of a rail car relative to said rail car, said operating apparatus comprising:

(a) a frame attachable to a vehicle;

(b) a flexible tension member attachable to said side door;

(c) a power actuator assembly supported by said frame and capable of forcing movement of said flexible tension member relative to said frame; and (d) said power actuator-assembly including a pair of spaced guide pulley assemblies, each pulley assembly having a retaining member selectively movable between a first position and a second position, where said first position retains said flexible tension member in an engaged position with respect to said pulley assembly and said second position permits said flexible tension member to be disengaged from said pulley assembly.

19. The apparatus of claim 18 wherein said vehicle is automotive.

20. The apparatus of claim 18 wherein said frame is attachable to said vehicle so that said guide pulley assemblies are laterally spaced from each other along a direction substantially transverse to a direction of travel of said vehicle.

21. The apparatus of claim 18 wherein said power actuator assembly includes a winch from which said tension member extends.

22. The apparatus of claim 18 wherein said frame is attachable to said vehicle so that said pair of guide pulley assemblies is located on laterally opposite sides of a centerline of said vehicle which extends along a direction of travel thereof.

23. The apparatus of claim 18 wherein at least one of said guide pulley assemblies has a rotational axis whose position is adjustable relative to said frame.

24. Door operating apparatus for moving a side door of a rail car relative to said rail car, said operating apparatus comprising:

(a) a frame matingly mountable on a load-lifting apparatus of a lift truck so as to be liftable thereby;

(b) an engagement member attachable to said side door; and (c) a power actuator assembly supported by said frame and capable of forcing movement of said engagement member relative to said frame in a substantially lateral direction when said frame is matingly mounted on said load-lifting apparatus.

25. The apparatus of claim 24, said frame being detachably engageable by said load-lifting apparatus to mount said frame on said lift truck.

26. The apparatus of claim 25 wherein said frame includes hollow sleeves for insertion of load-lifting forks of said lift truck.

27. The apparatus of claim 25 wherein said frame includes surfaces supportably engageable by a load-lifting clamp of said lift truck.

28. The apparatus of claim 27 wherein said surfaces are arcuate so as to be supportably engageable by a clamp of said lift truck adapted to handle cylindrical loads.

* * * * *

UNITED STATES PATENT AND TRADEMARK OFFICE

CERTIFICATE OF CORRECTION

PATENT NO. : 6,572,082 B1
DATED : June 3, 2003
INVENTOR(S) : Thomas E. Dixon et al.

It is certified that error appears in the above-identified patent and that said Letters Patent is hereby corrected as shown below:

Column 3,
Line 34, change “the. lift truck” to -- the lift truck --.

Column 7,
Line 47, change “actuator-assembly” to -- actuator assembly --.

Signed and Sealed this

Seventh Day of September, 2004

JON W. DUDAS
*Director of the United States Patent and Trademark Office*